United States Patent [19]

Resio

[11] 4,373,640

[45] Feb. 15, 1983

[54] MEDICINE BOTTLE ACCESSORY

[76] Inventor: George F. Resio, 212 Mary St., Old Forge, Pa. 18518

[21] Appl. No.: 827,852

[22] Filed: Aug. 26, 1977

[51] Int. Cl.[2] ..... B65D 41/26; B65D 51/24; B65D 55/00

[52] U.S. Cl. ..... 215/228; 215/DIG. 5

[58] Field of Search ..... 215/DIG. 5, 228

[56] References Cited

U.S. PATENT DOCUMENTS

| | | | |
|---|---|---|---|
| 1,174,628 | 3/1916 | Sidmay | 215/228 |
| 1,425,456 | 8/1922 | Dial | 215/228 |
| 1,784,880 | 12/1930 | Phillipson | 215/DIG. 5 |
| 2,995,265 | 8/1961 | Soderberg | 215/DIG. 5 |
| 3,730,372 | 5/1973 | Komendowski | 215/DIG. 5 |

FOREIGN PATENT DOCUMENTS

| | | | |
|---|---|---|---|
| 1087491 | 8/1954 | France | 215/DIG. 5 |

*Primary Examiner*—Herbert F. Ross
*Attorney, Agent, or Firm*—Daniel Jay Tick

[57] ABSTRACT

A bottle top of generally cup type configuration is removably affixed to a medicine bottle at the open top thereof for selectively opening and closing such top. A plastic spoon has an elongated stem integrally formed with the bottle top and extends therefrom. Thus, a consumer of medicine from the bottle having a contagious illness prevents the spread of his illness by utilizing the spoon to convey medicine from the bottle to his mouth.

3 Claims, 3 Drawing Figures

MEDICINE BOTTLE ACCESSORY

BACKGROUND OF THE INVENTION

The present invention relates to a medicine bottle accessory. More particularly, the invention relates to a medicine bottle accessory for a medicine bottle having an open top.

Objects of the invention are to provide a medicine bottle accessory of simple structure, which is inexpensive in manufacture, utilized with facility and convenience, and functions efficiently, effectively and reliably to permit a person with a contagious illness to consume medicine without spreading his contagion through utensils which would otherwise be used. The medicine bottle accessory of the invention provides a personal spoon for the consumer of medicine, thereby preventing the spread of contagion.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
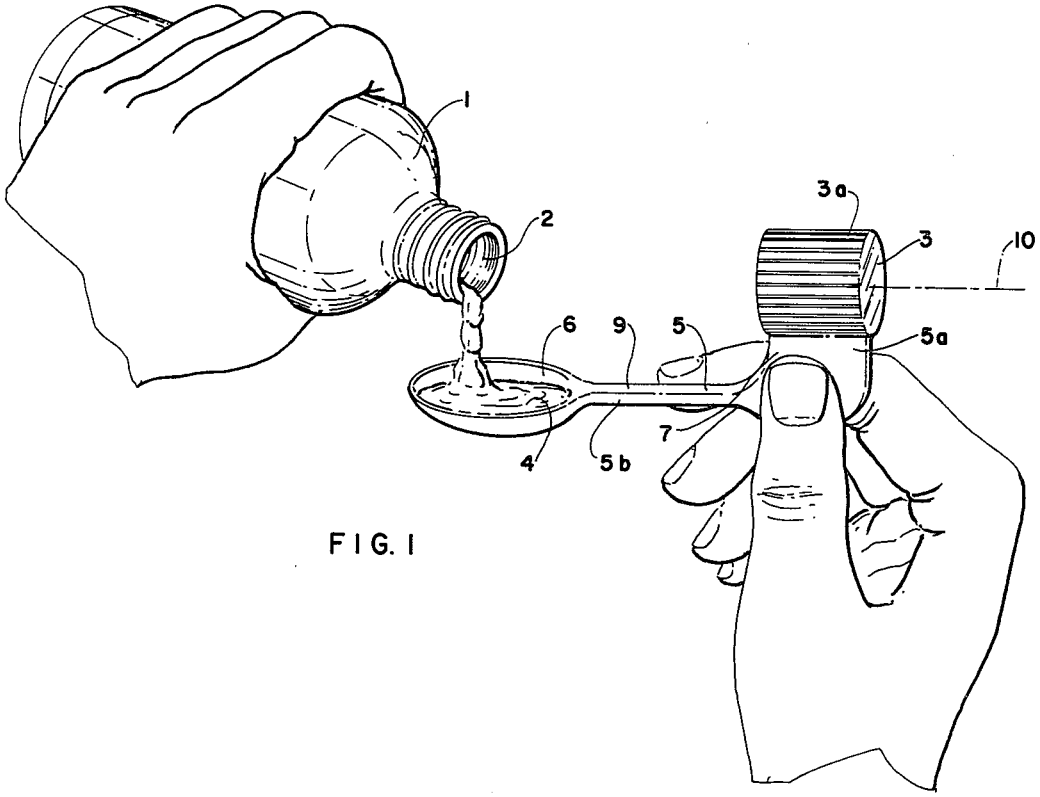
FIG. 1 is a perspective view of an embodiment of the medicine bottle accessory of the invention in use.

The medicine bottle accessory of the invention is for a medicine bottle 1 having an open top a (FIG. 1).

The medicine bottle accessory of the invention comprises a plastic bottle top 3 of generally cup type configuration removably affixed to the bottle 1 at the top 2 thereof for selectively opening and closing the open top of the bottle. The bottle top 3 is of substantially cylindrical configuration and has a cylindrical side 3*a*.

In accordance with the invention, a plastic spoon 4 is integrally formed with the bottle top 3 and extends therefrom whereby a consumer of medicine from the bottle 1 having a contagious illness prevents the spread of his illness by utilizing the spoon to convey medicine from the bottle to his mouth. In other words, the spoon 4 is used to take the appropriate dosages of medicine from the bottle 1 so that the consumer has a personal utensil for accomplishing this. This cuts off the usual spread of contagion through the use of common utensils.

The spoon 4 has an elongated stem 5 having spaced opposite first and second ends 5*a* and 5*b*. The stem 5 extends from the bottle top 3 at its first end 5*a*. An open receptacle 6 extends from the second end 5*b* of the stem 5.

Figure 2:
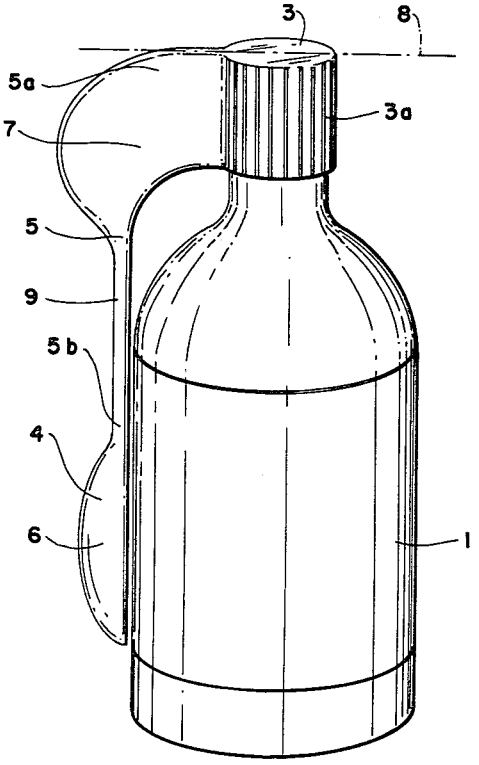
FIG. 2 is a side view of the embodiment of FIG. 1.
Figure 3:
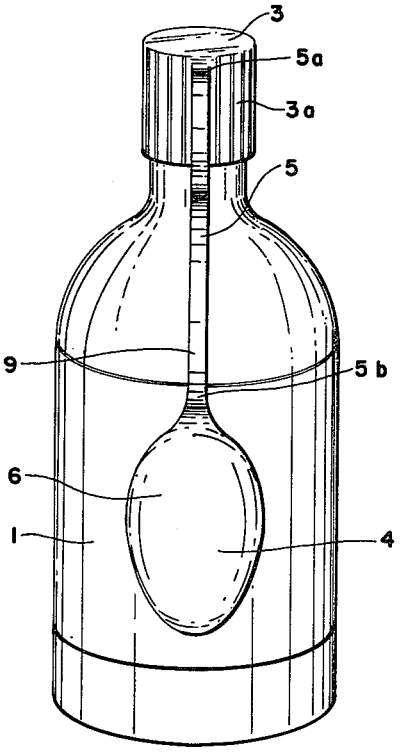
FIG. 3 is a bottom view of the embodiment of FIG. 1.

The step 5 of the spoon 4 is of substantially L-shape and has a first part 7 (FIGS. 1 and 2) in the area of the first end 5*a* thereof substantially coplanar with a diametrical plane 8 (FIG. 2) through the bottle top 3. The first part 7 of the stem 5 extends substantially radially from the side of the bottle top 3, as shown in the FIGS.

The stem 5 of the spoon 4 has a second part 9 in the area of the second end 5*b* of said stem substantially perpendicular to the first part 7 of said stem and in spaced substantially parallel relation with the axis 10 (FIG. 1) of the bottle top 3.

While the invention has been described by means of a specific example and in a specific embodiment, I do not wish to be limited thereto, for obvious modifications will occur to those skilled in the art without departing from the spirit and scope of the invention.

I claim:

1. A medicine bottle accessory for a medicine bottle having an open top, said medicine bottle accessory comprising a bottle top of generally cup type configuration removably affixed to the bottle at the top thereof for selectively opening and closing the open top of the bottle, and a spoon integrally formed with the bottle top and extending therefrom whereby a consumer of medicine from the bottle having a contagious illness prevents the spread of his illness by utilizing the spoon to convey medicine from the bottle to his mouth, said spoon having an elongated stem having spaced opposite first and second ends and extending from the bottle top and forming a finger grip at its first end, and an open receptacle extending from the second end of the stem, said stem being of substantially L-shape having a first part in the area of the first end thereof substantially coplanar with a diametrical plane through the bottle top and a second part in the area of the second end thereof substantially perpendicular to the first part of the stem and in spaced substantially parallel relation with the axis of the bottle top.

2. A medicine bottle accessory as claimed in claim 1, wherein the bottle top and the spoon consist of plastic material.

3. A medicine bottle accessory as claimed in claim 1, wherein the bottle top is of substantially cylindrical configuration and has a substantially cylindrical side and the first part of the stem of the spoon extends substantially radially from the side of said bottle top.

* * * * *